US006409425B1

(12) United States Patent
Okabe et al.

(10) Patent No.: US 6,409,425 B1
(45) Date of Patent: Jun. 25, 2002

(54) HAND GUIDED VIBRATING ROLLER

(75) Inventors: Mikio Okabe; Tetsuya Koseki, both of Saitama (JP)

(73) Assignee: Sakai Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/698,194

(22) Filed: Oct. 30, 2000

(30) Foreign Application Priority Data

Oct. 28, 1999 (JP) ..... 11-306475
Sep. 21, 2000 (JP) ..... 2000-286916

(51) Int. Cl.[7] ..... E01C 19/38; E01C 19/24
(52) U.S. Cl. ..... 404/117; 404/122; 404/131; 404/133.1
(58) Field of Search ..... 404/117, 122, 404/128, 131, 133.1, 84.1, 126

(56) References Cited

U.S. PATENT DOCUMENTS 3,394,641 A * 7/1968 Steck ..... 404/122
3,737,243 A * 6/1973 Dresher ..... 404/122
3,814,531 A * 6/1974 Carnahan et al. ..... 404/117
4,109,742 A * 8/1978 Fairchild et al. ..... 180/20
6,302,620 B1 * 10/2001 Mutsuji et al. ..... 404/131

FOREIGN PATENT DOCUMENTS

JP 2000-27115 * 1/2000
JP 2000-170117 6/2000 ..... E01C/19/26

* cited by examiner

*Primary Examiner*—Gary S. Hartmann
(74) *Attorney, Agent, or Firm*—Sughrue Mion, PLLC

(57) ABSTRACT

A hand guided vibrating roller includes a pair of front and rear roller wheels provided in parallel, a machine supported by the pair of the roller wheels, a hydraulic pump mounted on the machine, hydraulic motors for driving the roller wheels, provided inside the roller wheels, and a steering rod elongating from the rear portion of the machine. It further includes a supporting frame freely rotated around a vertical axis, supporting at least one of the roller wheels, and a steering cylinder for rotating the supporting frame.

3 Claims, 13 Drawing Sheets

HAND GUIDED VIBRATING ROLLER

BACKGROUND OF THE INVENTION

1. Field of the Invention

The present invention relates to a hand guided vibrating roller for compacting the ground by vibrating a pair of roller wheels provided at the front and rear of a body.

2. Description of Related Art

Vibrating rollers are compacting machines with roller wheels that are vibrated by a vibration generating apparatus provided at the inside of the roller wheel or the body to apply a vibratory force together with its weight to enhance the compacting effects. Hand guided vibrating rollers are comparatively small and lightweight among the vibrating rollers and non ride-on type machines. The operating performance of the hand guided vibrating roller is superior in the initial compaction of the asphalt pavement, the compaction of the shoulder of a road, a sidewalk, a narrow alley and others, so that the hand guided vibrating roller is widely used in the municipal road maintenance and the environmental maintenance.

FIG. 1 shows a conventional hand guided vibrating roller 90. The hand guided vibrating roller 90 comprises an engine 91, a machine 92 mounting a hydraulic pump (not shown) and others, a front roller wheel 93A and a rear roller wheel 93B arranged in parallel to support the machine 92, a hydraulic motor (not shown) for transmitting a driving force to the front roller wheel 93A and the rear roller wheel 93B by a pressure oil from the hydraulic pump, and a steering rod 95 connected to a rear end of the machine 92 over a connecting bracket 94.

The hand guided vibrating roller 90 travels in the area to be compacted with the roller wheels 93A, 93B vibrating. When the direction needs to be changed (hereinafter called steering n) during operation, a worker pushes or pulls the steering rod 95 to the left or the right to face the whole hand guided vibrating roller to the desired direction.

The hand guided vibrating roller 90 masses 500 kg to 1000 kg. In the case of the steering, the worker holds the steering rod 95 with both hands and operates it with all his strength, which can only be handled by a skillful worker and which requires a lot of labor. In order to reduce the force required in the steering, the steering rod 95 is made longer to make the turning force smaller; however, the required force is still large.

Further, if the steering rod 95 is made longer, because the steering rod 95 cannot be controlled in the compaction of the narrow road and narrow ditch, the steering cannot be performed.

Furthermore, during the compacting operation, the worker needs to move on the compacted area right after the compaction while holding the steering rod 95, which may lower the quality of the compacted area.

SUMMARY OF THE INVENTION

It is an object of the present invention to provide a hand guided vibrating roller which does not require a large force and which does not require complicated operations and which can easily perform the steering in a small space.

In order to achieve the above object, a hand guided vibrating roller of the present invention, which comprises a pair of front and rear roller wheels provided in parallel, a machine supported by the pair of the front and rear roller wheels, a hydraulic pump mounted on the machine, a hydraulic motor for driving the roller wheels, provided inside the roller wheels, and a steering rod elongating from the rear portion of the machine, comprises a supporting frame freely rotated around a vertical axis, supporting at least one of the roller wheels, and an actuator for rotating the supporting frame.

Accordingly, the roller wheel can be rotated through the supporting frame by an actuator, so that the steering is not hand-operated and the fatigues due to the steering can be relieved and further the safety can be improved.

Here, a hydraulic cylinder may be used as the actuator. In this case, the supporting frame can readily be rotated by the expansion and the contraction of a cylinder rod of the hydraulic cylinder.

Further, the hand guided vibrating roller of the present invention may comprise a pressure oil supplying means connected to the hydraulic cylinder with a hydraulic hose having a directional control valve, and a directional control valve operating means for switching the directional control valve provided at a drive operating unit attached to the steering rod.

Here, the drive operating unit is a part for making the hand guided vibrating roller travel forward and backward, terminate, and perform the steering.

Further, it is preferable to use a solenoid directional control valve (herein after called a solenoid switching valve) as the directional control valve; however, the hand-operated directional control valve (herein after called a hand-operated switching valve) can be used.

Accordingly, the hydraulic cylinder is connected to the pressure supplying means with the hydraulic hose having the directional control valve, and the directional control valve operating means is integrated with the drive operating unit attached to the steering rod, so that the hand guided vibrating roller is superior in the operating performance.

Further, in the hand guided vibrating roller of the present invention, the directional control valve may be a solenoid directional control valve, and a solenoid directional control valve operating means for switching the solenoid directional control valve is provided at a forward-backward movement lever attached to the drive operating unit. The operating performance of the hand guided vibrating roller can be improved.

Furthermore, the hand guided vibrating roller of the present invention further comprises an automatic roller wheel neutralizing apparatus including a rotating position detecting means for detecting the rotating position of the roller wheel rotated in one direction around a vertical axis, and a neutral position restoring means for restoring the roller wheel to the straight forward traveling state by rotating the roller wheel in the direction opposite to the current rotating direction based on the rotating position detected by the rotating position detecting means.

Accordingly, when at least one of the roller wheels is rotated in one direction, clockwise or counterclockwise, the roller wheel of the hand guided vibrating roller can automatically be made in the straight forward traveling state by operating the automatic roller wheel neutralizing apparatus without the complicated operations.

Further, in the hand guide vibrating roller of the present invention, the supporting frame is rotatively supported by a slewing rim bearing provided right above the roller wheel, and the hydraulic pump and the hydraulic motor for driving the roller wheel are jointed by hydraulic hoses inserted into a hollow portion of the slewing rim bearing.

Accordingly, since the supporting frame is rotatively supported by a slewing rim bearing provided right above the roller wheel, the hydraulic hoses connected the hydraulic pump with the hydraulic motor for driving the roller wheel can be inserted through the hollow portion formed at the circumference of the center of pivot of the slewing rim bearing, so that the hydraulic hoses can be piped efficiently. Therefore, the damage of the hydraulic hoses caused by the dynamic bending and tension of the hydraulic hoses due to the rotation of the supporting frame can be prevented. As a result, the durability and reliability of the hydraulic hoses can be improved.

In the hand guide vibrating roller of the present invention, a fixing member having a through hole for the hydraulic hoses may be fitted in the hollow portion of the slewing rim bearing.

Here, the through holes for the hydraulic hoses can be any number and any shape unless they hold the movement of the hydraulic hoses. Further, the material of the fixing member is not limited but it is preferably made of rubber or synthetic resin.

Accordingly, the fixing member for the hydraulic hoses is fitted in the hollow portion, and the hydraulic hoses are inserted into the through holes. Then, the movement of the hydraulic hoses can be held. Therefore, the hydraulic hoses can be prevented from touching the inner face of the slewing rim bearing, which protects the hydraulic hoses.

BRIEF DESCRIPTION OF THE DRAWINGS

FIGS. 8A, 8B show a case of counterclockwise rotation. FIGS. 8C, 8D show a case of straight traveling. FIGS. 8E, 8F show a case of clockwise rotation.

DESCRIPTION OF THE PREFERRED EMBODIMENTS

Figure 1:
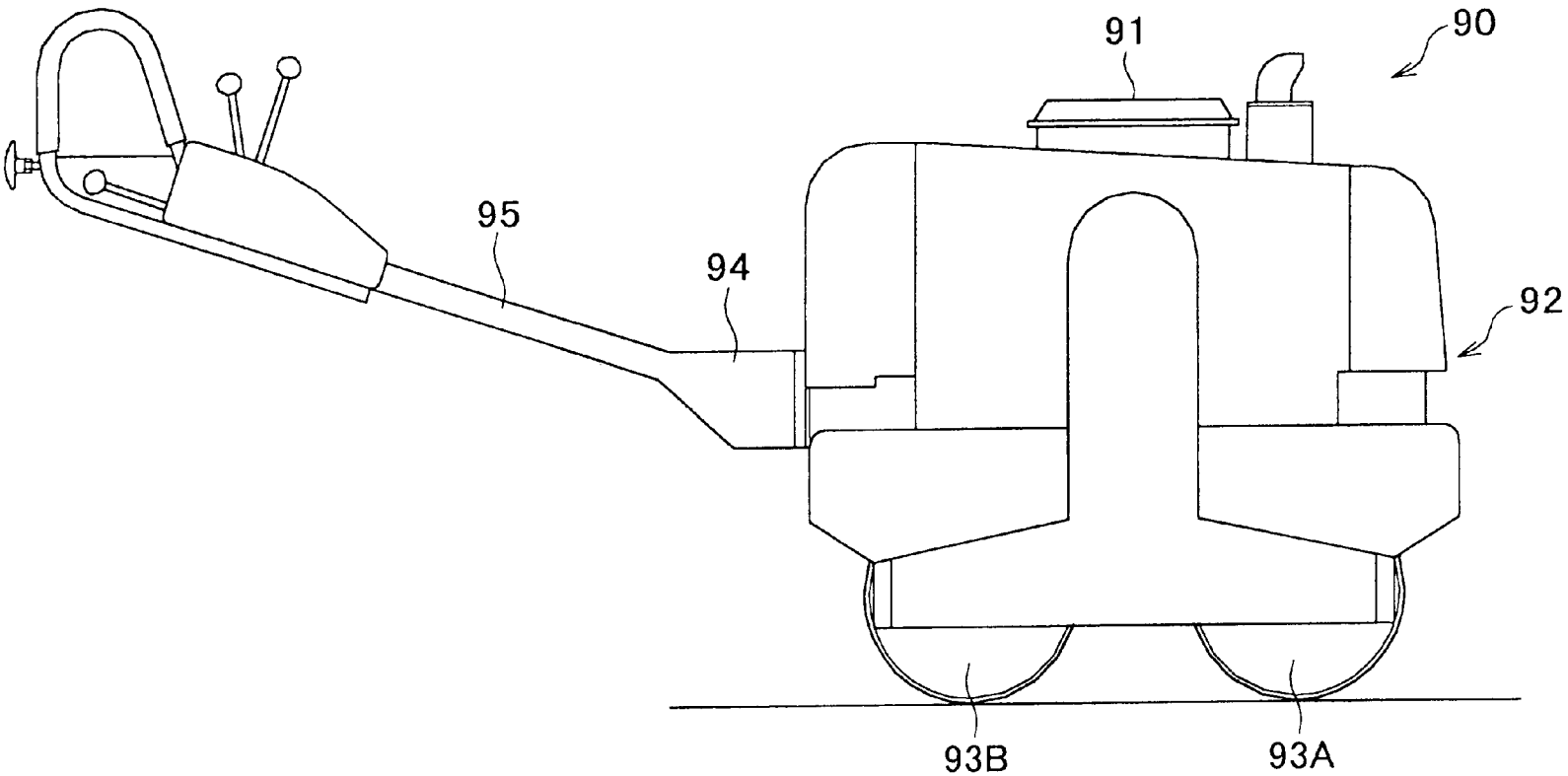
FIG.1 PRIOR ART
FIG. 1 is a side view showing the conventional hand guided vibrating roller.

The preferred embodiments of the present invention will be described hereinafter with reference to the accompanying drawings. In the following description and the drawings, the same reference numerals are used for the same components and repetitive description on the same components will be omitted.

<First Embodiment>

1) Construction

[Construction of a Hand Guided Vibrating Roller H]

Figure 2:
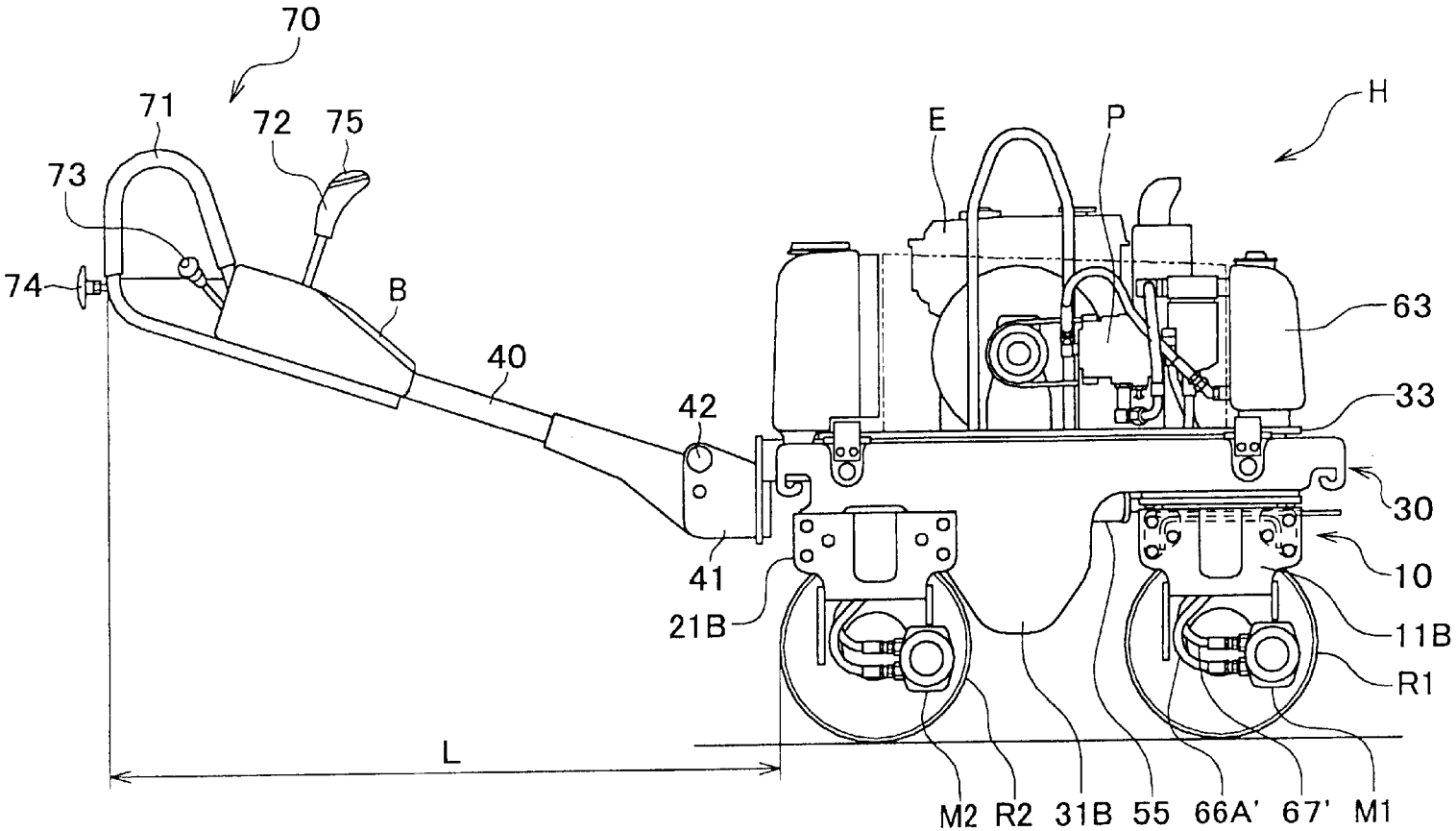
FIG. 2 is a side view showing a hand guided vibrating roller according to the first embodiment of the present invention.

FIG. 2 shows a hand guided vibrating roller H of the first embodiment of the present invention. The hand guided vibrating roller H comprises a pair of front and rear roller wheels R1 and R2 provided in parallel and a machine 30 supported by the pair of the front and rear roller wheels R1, R2.

Figure 3:
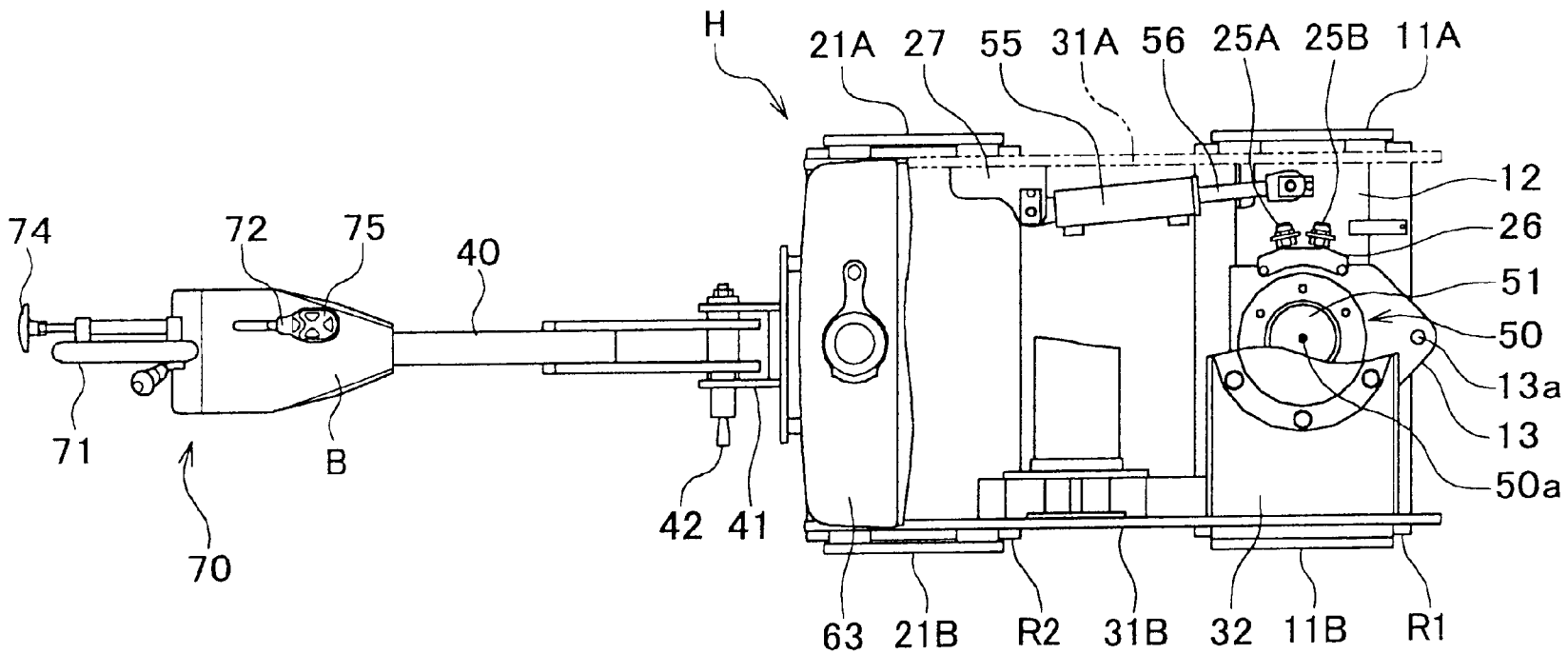
FIG. 3 is a plan view showing the hand guided vibrating roller of the first embodiment partially showing the inside.
Figure 4:
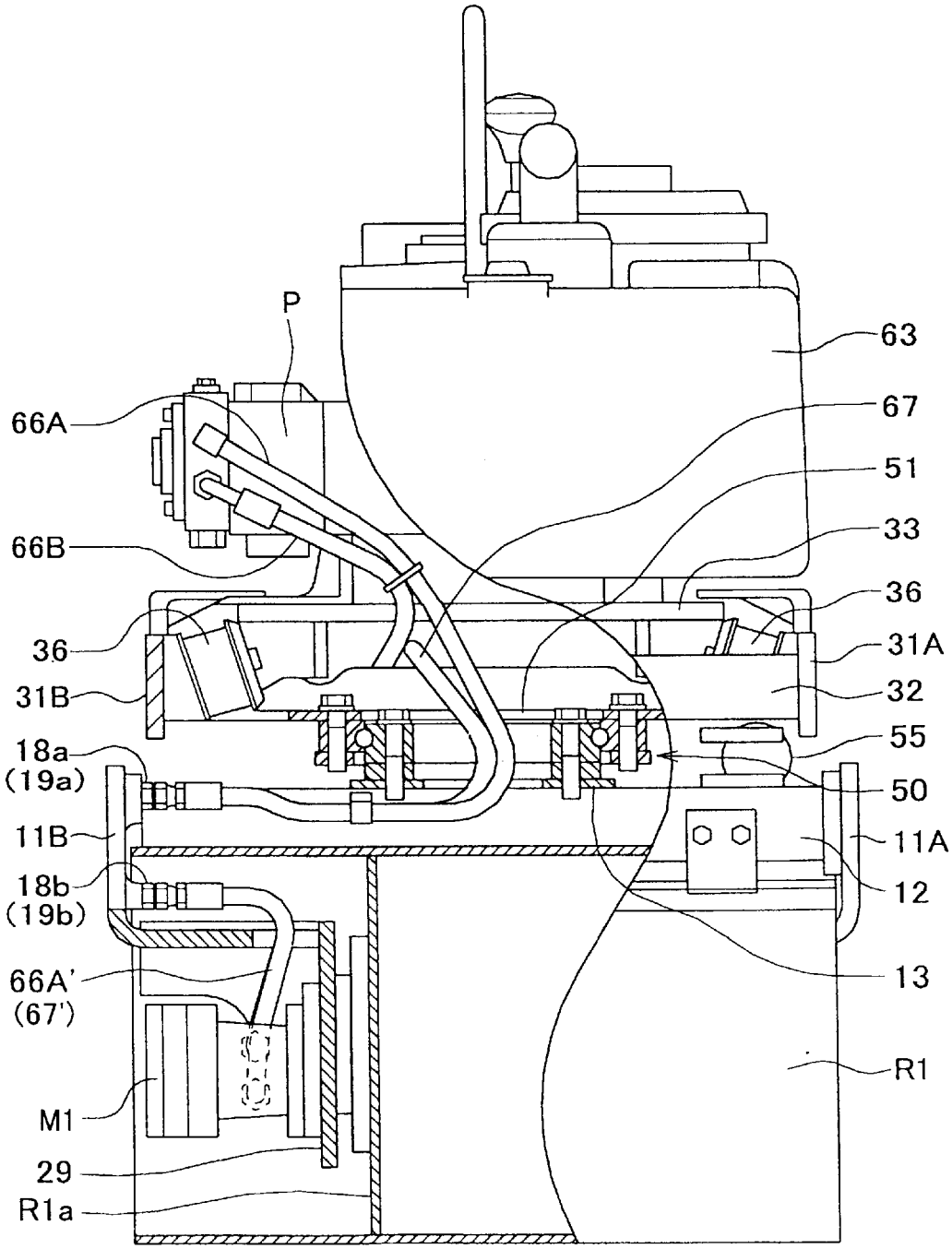
FIG. 4 is a front view showing the hand guided vibrating roller of the first embodiment partially showing the inside.

As shown in FIGS. 3 and 4, the machine 30 comprises left and right body frames 31A, 31B, a load holding plate 33 provided above the left and right body frames 31A, 31B over a rubber vibration isolator 36, and an upper beam material 32 connected to the under portion of the left and right body frames 31A, 31B. There are an engine E that is a driving source, a hydraulic pump P driven by the engine E, an oil tank 63 connected to the hydraulic pump P and other devices mounted on the load holding plate 33. The devices such as the engine E on the plate 33 are prevented from the excessive vibrations by the action of the rubber vibration isolator 36.

Further, the front roller wheel R1 and the rear roller wheel R2 are provided to a supporting frame 10 and the body frames 31A, 31B over left and right supporting frames 21A, 21B so as to be slidable, respectively. Furthermore, there are left and right mirror plates facing to the other in the front and rear roller wheels R1, R2 (only the right mirror plate R1*a* of the roller wheel R1 is shown). There is a hydraulic motor M1 (hydraulic motors for driving the roller wheel) connected to the hydraulic pump P in the position eccentric from the center of the roller wheel R1 at the outer side surface of the mirror plate R1*a* over a motor fixing plate 29. The rotation of the hydraulic motor M1 is achieved by engaging a driving gear (not shown) provided to an output shaft of the hydraulic motor M1 with a rotating gear (not shown) provided to a wheel shaft of the roller wheel R1, which transmits the driving force to the front roller wheel R1. The rear roller wheel R2 receives the driving force in the same way as in the front roller wheel R1.

A steering rod 40 is provided, elongating from the rear end of the machine 30 through a connecting bracket 41. The steering rod 40 can be folded at a movable pin 42, which can reduce the storage space.

[Supporting Frame 10]

In the present embodiment, the supporting frame 10 for supporting the front roller wheel R1 comprises a slewing rim bearing 50 and a steering cylinder 55, so that it can freely be rotated around the vertical axis. This construction will be described in detail referring to FIGS. 3, 4.

The supporting frame 10 comprises left and right supporting frames 11A, 11B, a lower beam material 12 across the upper portions of the supporting frames 11A, 11B, and a bearing support 13 connected at the position above the lower beam material 12 and right above the central portion of the front roller wheel R1. The front roller wheel R1 is rotatively supported by the left and right supporting frames 11A, 11B.

The ball bearing type slewing rim bearing 50 is provided between the upper beam material 32 of the machine 30 and the bearing support 13 so that the supporting frame 10 is supported so as to be rotated around the axis of a perpendicular line passing the center of rotation 50*a* of the slewing rim bearing 50.

Further, there are holes formed at the circumference of the center of rotation 50*a* of the slewing rim bearing 50. Moreover, there are through holes formed at the bearing support 13 and the upper beam material 31 where the holes of the slewing rim bearing 50 correspond to. There is a hollow portion 51 between the bearing support 13 and the upper beam material 32. The bearing support 13 comprises a hole 13*a* for a securing pin to secure the rotating position of the slewing rim bearing 50 at an end.

Furthermore, the end of the steering cylinder 55 (hydraulic cylinder) is provided at a bracket 27 fixed at the left body frame 31A, and the end of the cylinder rod 56 of the steering cylinder 55 is provided at the left end of the lower beam material 12.

Figure 6:
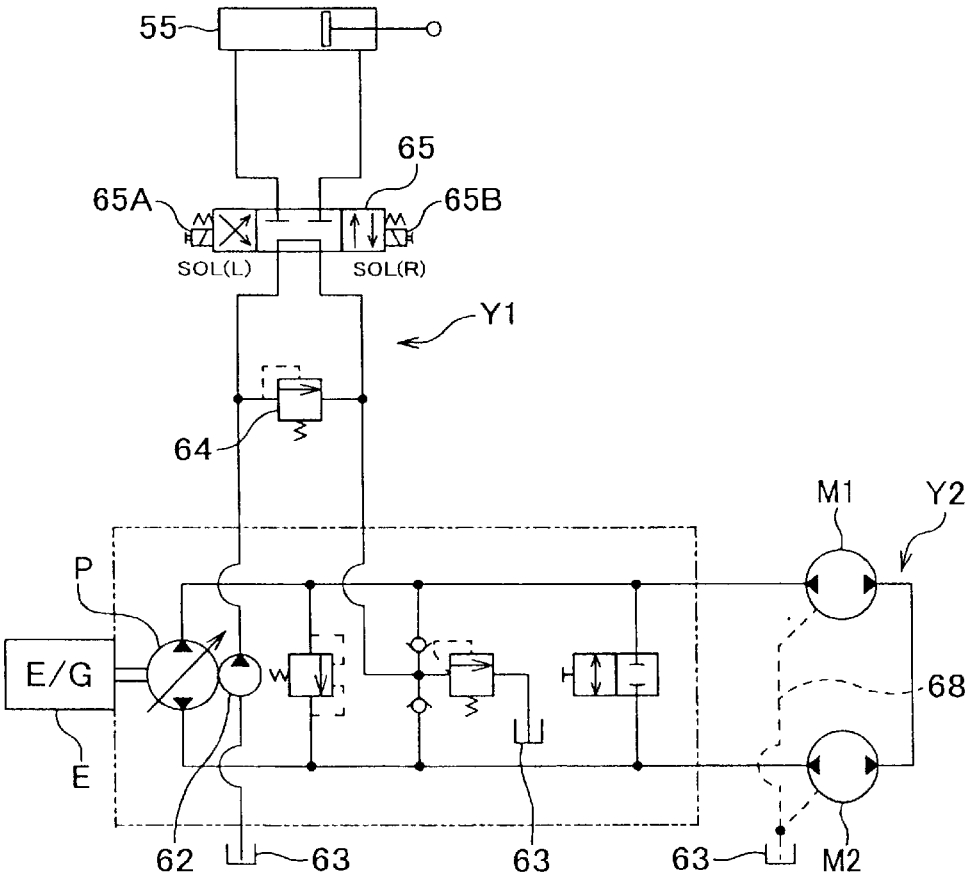
FIG. 6 is a hydraulic circuit diagram of the hand guided vibrating roller of the first embodiment.

The cylinder rod 56 is constructed to be retractable owing to the supply of the pressure oil from a charging pump 62 of a hydraulic motor driving hydraulic circuit Y2 (see FIG. 6).

The cylinder rod 56 has the suitable length so that the expansion length changes the rotation angle θ of the front roller wheel R1 (see FIGS. 8A–8F). In particular, the length is determined so that when the cylinder rod 56 expands most, the front roller wheel R1 is rotated 15 degrees clockwise and that when the cylinder rod 56 contracts most, the front roller wheel R1 is rotated 15 degrees counterclockwise. Further, when the expansion of the cylinder rod 56 is in the middle, the rotation angle of the front roller wheel R1 is zero degree (hereafter called a neutral position), which means that the front roller wheel R1 is in the straight forward traveling state.

It should be noted that the rotation angle θ means an angle orga formed between a basic line m passing through the center of rotation 50*a* of the slewing rim bearing 50 and orthogonal to the left and right body frames 31A, 31B and an axis n with respect to the supporting frame 10 of the front roller wheel R1.

Since the supporting frame 10 is thus constructed, the supporting frame 10 can be rotated by the expansion and contraction of the cylinder rod 56 of the steering cylinder 55, so that the front roller wheel R1 supported by the supporting frame 10 can be rotated around the vertical axis.

[Connection Between the Hydraulic Pump P and the Hydraulic Motors M1, M2]

The hydraulic pump P is connected to the hydraulic motors M1, M2 through hydraulic hoses having the flexibility. The hydraulic motors M1, M2 are driven by the operation of the hydraulic pump P.

As shown in FIG. 4, the hydraulic pump P is connected to hose lines 66A, 66B (hydraulic hoses). The hose line 66A pipes to the front roller wheel R1 to connect the hydraulic motor M1 contained in the front roller wheel R1. On the other hand, the hose line 66B pipes to the rear roller wheel R2 to connect the hydraulic motor M2 contained in the rear roller wheel R2. Further, the front and rear hydraulic motors M1, M2 are connected through a hose line 67.

There are holes (not shown) having a depth corresponding to the plate thickness at the side plates of the right supporting frames 11B, 21B where the piped positions of the hose lines 66A, 67 and the hose lines 66B, 67 correspond to. Further, there are joint members 18*a*, 19*a*, 18*b*, 19*b* attached at the upper and lower positions of the holes. Then, the hose lines 66A, 67 are connected to the upper joint members 18*a*, 19*a*, and hose lines 66A', 67' connected to the hydraulic motor M1 attached to the motor fixing plate 29 of the front roller wheel R1 are connected to the lower joint members 18*b*, 19*b*.

Regarding to the other hose lines 66B, 67, they are connected to the hydraulic motor M2 in the same way as above.

Accordingly, the hydraulic hoses are connected to the right supporting frames 11B, 21B without exposing to the outside.

Here, the hose lines 66A, 67 which are connected to the front roller wheel R1 and which are bundled to be prevented from touching the inner surface of the slewing rim bearing 50 are inserted through the hollow portion 51 formed by the bearing support 13, the slewing rim bearing 50 and the upper beam frame 32, and clamped between the hollow portion 51 and the right supporting frame 11B so as not to touch the front roller wheel R1. Accordingly, since hose lines 66A, 67 are inserted through the hollow portion 51, the hose lines 66A, 67 can be piped near the center of rotation 50*a* efficiently. Therefore, the damage of the hose lines 66A, 67 caused by the repeated bending and tension of the hose lines 66A, 67 due to the rotation of the supporting frame 10, and the hand guided vibrating roller H can be miniaturized.

[Drive Operating Unit 70]

Figure 7:
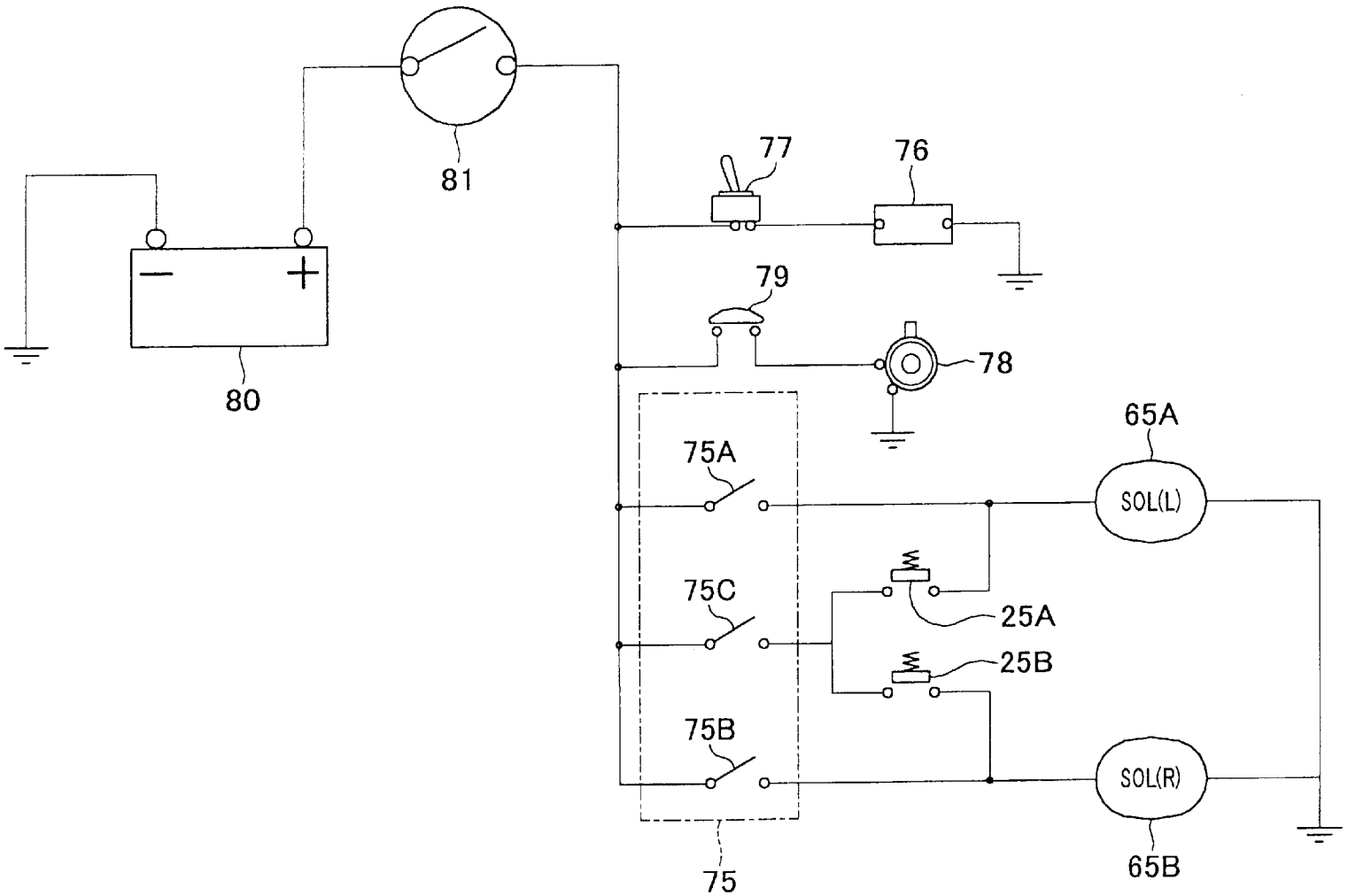
FIG. 7 is an electric circuitry diagram constituting an automatic roller wheel neutralizing apparatus of the hand guided vibrating roller of the first embodiment.

As shown in FIG. 2, there is a drive operating unit 70 for making the hand guided vibrating roller H travel forward and backward, stop, perform the vibrating operation, and perform the steering to the left or right. direction. The drive operating unit 70 comprises a control handle 71 provided upright at the rear end of the steering rod 40, and a control box B arranged near the control handle 71. In the control box B, there arranged a forward-backward movement lever 72, a throttle lever 73, a safety operation knob 74, a vibration switch 77 for operating a vibration clutch 76, a horn switch 79 for operating a horn 78 (see FIG. 7) and others.

Figure 5:
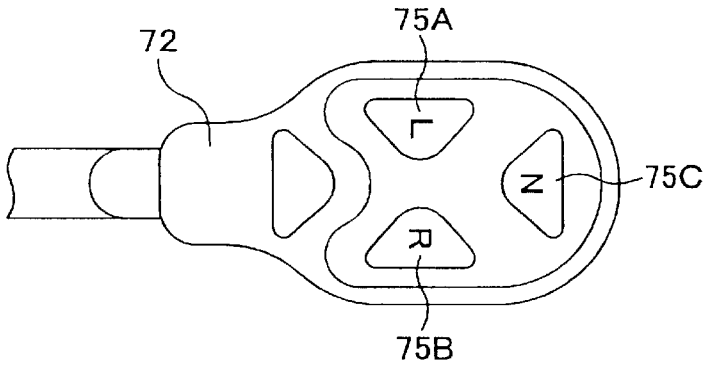
FIG. 5 is a plan view showing a forward-backward movement lever of the hand guided vibrating roller of the first embodiment.

As the forward-backward movement lever 72 is tilted forward or backward, the hand guided vibrating roller H travels forward or backward. Further, as shown in FIG. 5, the forward-backward movement lever 72 has a steering switch 75 (means of operating solenoid directional control valve) including a left steering switch 75A, a right steering switch 75B, and a neutral switch 75C.

As the left and right steering switches 75A, 75B and the neutral switch 75C are pushed, a solenoid switching valve 65 which will be describe later (see FIG. 6) provided at the hydraulic hoses connected between the steering cylinder 55 and the hydraulic pump P can be operated.

[Steering Hydraulic Circuit Y1]

Next, the steering hydraulic circuit Y1 for operating the steering cylinder 55 will be described referring to FIG. 6.

The steering hydraulic circuit Y1 is provided with the hydraulic motor driving hydraulic circuit Y2. The hydraulic motor driving hydraulic circuit Y2 connects the hydraulic pump P (variable capacity type) driven by the engine E to the hydraulic motors M1, M2 with the hydraulic hoses. The charging pump 62 connected with the oil tank 63 changes the predetermined amount of oil and supplies the oil for the oil leakage in the hydraulic motor driving hydraulic circuit Y2.

Further, when the forward-backward movement lever 72 (FIG. 2) is switched from the neutral position to the forward movement position or the backward movement position, the hydraulic pump P can change the flow of the pressure oil in the reverse direction. Owing to the flowing direction of the pressure oil, the rotating direction of the front and rear roller wheels R1, R2 can be changed through the hydraulic motors M1, M2. Furthermore, when the forward-backward movement lever 72 is in the neutral position, the oil supply from the hydraulic pump P is terminated.

The steering hydraulic circuit Y1 is a circuit for connecting the oil tank 63 to the charging pump 62 and the steering cylinder 55 with the hydraulic hoses. There are the solenoid switching valve 65 having the three-position four-connection and a pressure control valve 64 between the charging pump 62 and the steering cylinder 55. When the supporting frame 10 is rotated, the pressure oil is supplied from the charging pump 62 (means of supplying pressure oil) to one of the rooms of the steering cylinder 55.

The solenoid switching valve 65 excites and degausses left and right solenoids 65A, 65B by turning on or off left and right steering switches 75A, 75B attached to the forward-backward movement lever 72, thereby to switch the hydraulic circuits. Furthermore, the supply of pressure oil to the steering cylinder 55 can be terminated by operating the neutral switch 75C.

Accordingly, the cylinder rod 56 contracts when the left solenoid 65A is energized while the cylinder rod 56 expands when the right solenoid 65B is energized.

It should be noted that the left steering switch 75A and the right steering switch 75B send the oil to the steering cylinder 55 only when they are pushed. On the other hand, when they are not pushed, the oil sending to the steering cylinder 55 is terminated.

In the present embodiment, since the oil leakage from the hydraulic motors M1, M2 is returned to the oil tank 63, the drain hose line connecting the hydraulic motors M1, M2 with the oil tank 63 is not provided; however, a drain hose line 68 shown by a dotted line in FIG. 6 which shows a hand guided vibrating roller H' of the second embodiment of the present invention may be provided.

In the hand guided vibrating roller H of the present embodiment, the charging pump 62 for sending the oil to the hydraulic motor driving hydraulic circuit Y2 is used as the constituting element of the pressure oil supplying means for sending oil to the steering cylinder 55, so that another hydraulic pump or others for sending oil to the steering cylinder 55 is not required. However, another hydraulic pump can be used therefor.

Further, in the aforementioned embodiment, the solenoid switching valve 65 is used as a directional control valve; however, the hand-operated switching valve may be used as the directional control valve. In this case, a steering lever (means of operating a directional control valve) is provided to the steering rod 40 and the steering lever is connected to the hand-operated switching valve with a control cable, which can obtain the same achievement.

[Automatic Roller Wheel Neutralizing Apparatus T]

Next, the automatic roller wheel neutralizing apparatus T will be explained. In the following explanation, the roller wheel R1 which is rotative with the slewing rim bearing 50 is called a directional roller wheel R1.

The automatic roller wheel neutralizing apparatus T is an apparatus for automatically restoring the directional roller wheel R1 to the straight forward traveling state when the directional roller wheel R1 is rotated in one direction clockwise or counterclockwise, which is operated by pushing the neutral switch 75C of the steering switch 75. The automatic roller wheel neutralizing apparatus T comprises a rotating position detecting means for detecting the rotating position of the directional roller wheel R1, and a neutral position restoring means for restoring the directional roller wheel R1 in the straight forward traveling state.

As shown in FIGS. 3–8, the rotating position detecting means comprises a guide plate 26 bolted to the bearing support 13 of the supporting frame 10, and two left and right limit switches 25A, 25B attached to the upper beam material 32 of the machine 30 over the brackets 28A, 28B.

The guide plate 26 is a curved member concentric with the center of rotation 50*a* of the slewing rim bearing 50 and includes a notch 26*a* (see FIGS. 8A, 8B, 8C) for releasing the conducting state of the left and right limit switches 25A, 25B at the outer circumference. The notch 26*a* is formed to have the length corresponding to the maximum rotating angle of the directional roller wheel R1 at the center of the central portion of the guide plate (in the present embodiment, the portion corresponding to the clockwise direction of 15 degrees and the counterclockwise direction of 15 degrees).

Further, the guide plate 26 is placed at the position where the notch 26*a* is in the bilateral symmetry with the base line m when the directional roller wheel R1 is in the straight forward traveling state. Further, the guide plate 26 is arranged so that in a case of the rotating angle θ of zero degree, the left and right limit switches 25A, 25B are placed at both ends of the notch 26*a*.

According to the above-described configuration, in the case of the directional roller wheel R1 in the neutral position, the conducting state of the left and right limit switches 25A, 25B are both released. Further, in the case that the directional roller wheel R1 is rotated counterclockwise or clockwise, the left or right switch 25A or 25B is conducted. Therefore, the rotation of the directional roller wheel R1 can be detected from the conducting state of the left or right limit switch 25A or 25B.

The neutral position restoring means is means of restoring the directional roller wheel R1 to the straight forward traveling state by rotating it in the direction opposite to the rotating direction of the rotating position detected by the rotating position detecting means. Here, referring to FIG. 7, the electric circuit constituting the neutral position restoring means will be explained.

The steering switch 75 together with the vibration switch 77 and the horn switch 79 is connected to a plus terminal of a battery 80 over a starting switch 81.

The left and right steering switches 75A, 75B and the neutral switch 75C which constitute the steering switch 75 are connected in parallel, and the outputs of the left and right steering switches 75A, 75B are connected to the inputs of the left and right solenoids 65A, 65B, respectively.

Further, the output of the neutral switch 75C is diverged and connected to the inputs of the left and right limit switches 25A, 25B, and the outputs of the limit switches 25A, 25B are connected to the inputs of the left and right solenoids 65A, 65B, respectively.

According to the above-described configuration, in a case that the directional wheel roller R1 is rotated in one direction, the clockwise or counterclockwise direction (for example, in the case of the clockwise rotation, see FIGS. 8E, 8F), as the neutral switch 75C is pushed, the limit switch (left limit switch 25A) is conducted, and the solenoid (left solenoid 65A) acting to prevent the rotation is energized. Accordingly, the passage of the solenoid switching valve 65 is switched, and the cylinder rod 56 contracts. Then, the directional roller wheel R1 is rotated in the direction (counterclockwise direction) opposite to the rotating direction. It should be noted that when the directional roller wheel R1 is in the neutral position, because the conducting state of the left limit switch 25A is released, the solenoid switching valve 65 is switched to the neutral position. Therefore, the length of the cylinder rod 56 is locked in the neutral position and the directional roller wheel R1 is automatically restored to the neutral state.

In the above-described embodiment, the directional roller wheel R1 is rotated clockwise but in a case of the counterclockwise rotation, the operation is the same as above.

Further, in the case of the directional roller wheel R1 in the neutral position, since the conducting states of the left and right limit switches 25A, 25B are released, the automatic roller wheel neutralizing apparatus T does not operate even though the neutral switch 75C is pushed and the position of the directional roller wheel R1 is not changed.

The automatic roller wheel neutralizing apparatus T is an apparatus for automatically restoring the directional roller wheel R1 to the straight forward traveling state and comprises the rotating position detecting means and the neutral position restoring means. In the present embodiment, both means are formed in the integral configuration; however, each can be used independently.

For example, as the rotating position detecting means, a position sensor for detecting the position of the cylinder rod 56 can be provided in the steering cylinder 55, which achieves the same operation as in the above-described embodiment. In particular, an electric circuit (rotating position restoring means) for energizing the left solenoid 65A or the right solenoid 65B until the directional roller wheel R1 is in the neutral position on the basis of the length of the cylinder rod 56 may be formed, thereby to restore the cylinder rod 56 to the neutral position.

[Length L of the Rear Portion of the Hand Guided Vibrating Roller H]

Finally, the length L of the rear portion of the walk-behind type roller H will be explained.

The length L of the rear portion of the hand guided vibrating roller H is a horizontal length L from the rear end face of the control handle 71 (holding portion) of the steering rod 40 to the rear end face of the rear roller wheel R2 (see FIG. 2). The length L is preferably from 0.7 m to 1.25 m.

In the hand guided vibrating roller H of the present invention, since the steering rod 40 is not used in the steering, the steering rod 40 does not have to be provided, or a very short steering rod may be used. However, in such a case, during the compacting operation, if the worker comes too closer to the rear roller wheel R2, the rear roller wheel R2 may step on his foot or the worker may be injured accidentally due to the vibration or the reaction of the steering rod. Therefore, the preferred range of the length L of the rear portion is determined for the safety purpose.

2) Function

The function of the hand guided vibrating roller H having the above-described configuration will be described referring to FIGS. 8A, 8B, 8C, 8D, 8E, 8F.

First, a starter switch (not shown) provided at the steering rod 40 of the hand guided vibrating roller H is turned on to drive the engine E.

Next, the forward-backward movement lever 72 is operated to travel the hand guided vibrating roller H in the desired direction. The vibration may be started if required.

When the direction of the hand guided vibrating roller H needs to be changed during traveling or stopping, the steering switch for the desired direction of the steering, e.g., the right steering switch 75B is pushed. Then, the right solenoid 65B is energized and the passage of the solenoid switching valve 65 is switched to send the oil to the steering cylinder 55. The cylinder rod 56 expands and the front roller wheel R1 is rotated clockwise over the supporting frame 10 (see FIGS. 8E, 8F).

Thereafter, the worker stops pushing the right steering switch when the desired directional angle achieves. Then, the conducting state of the right solenoid 65B is released, so that the oil sending to the steering cylinder 55 is terminated to lock the rotating position of the front roller wheel R1.

Figure 8B:
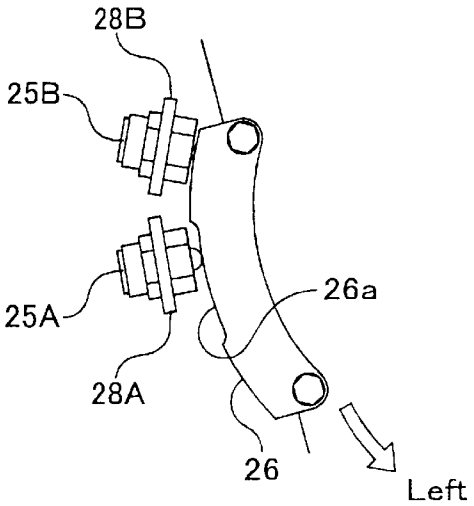
FIGS. 8A, 8B, 8C, 8D, 8E, 8F are schematic plan views for describing the operation in the steering of the hand guided vibrating roller of the first embodiment.
Figure 8A:
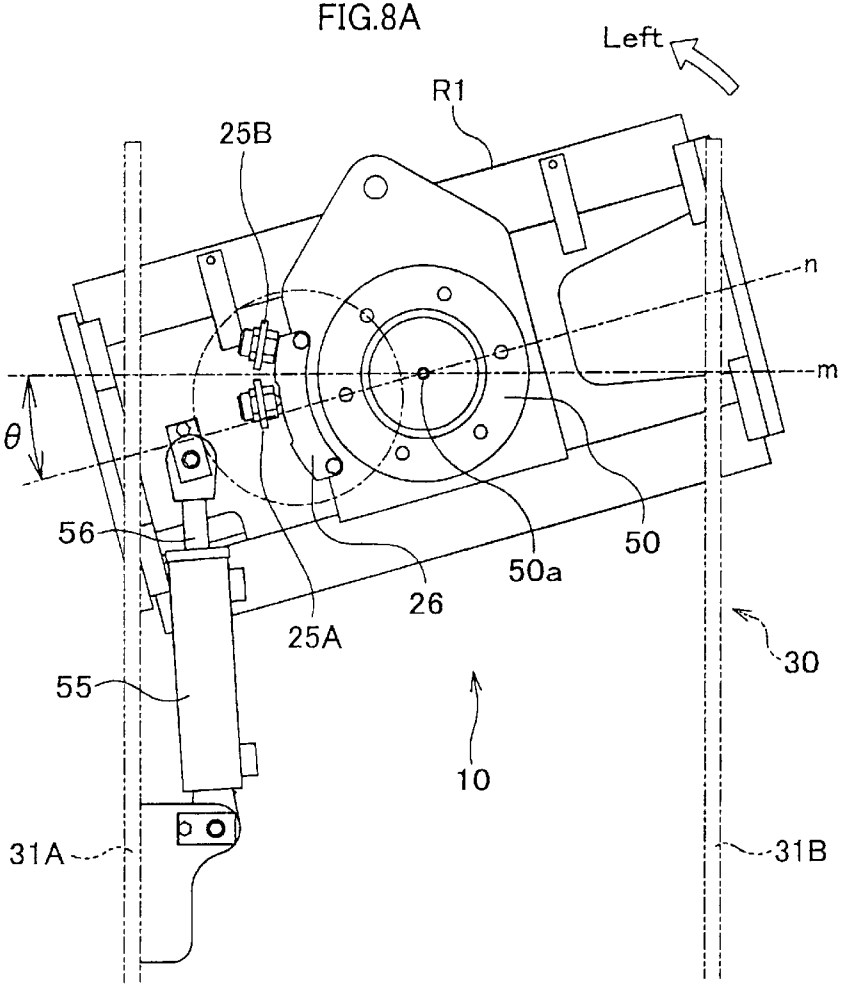
Figure 8D:
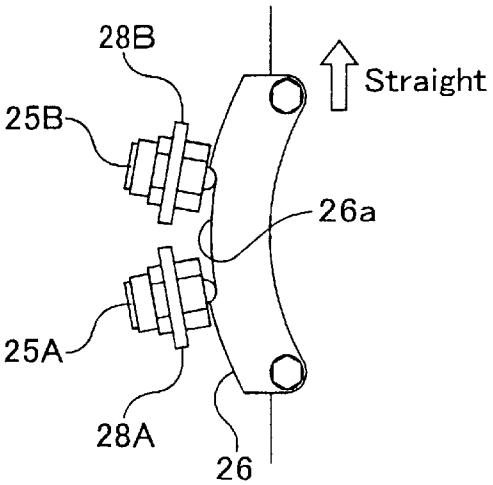
Figure 8C:
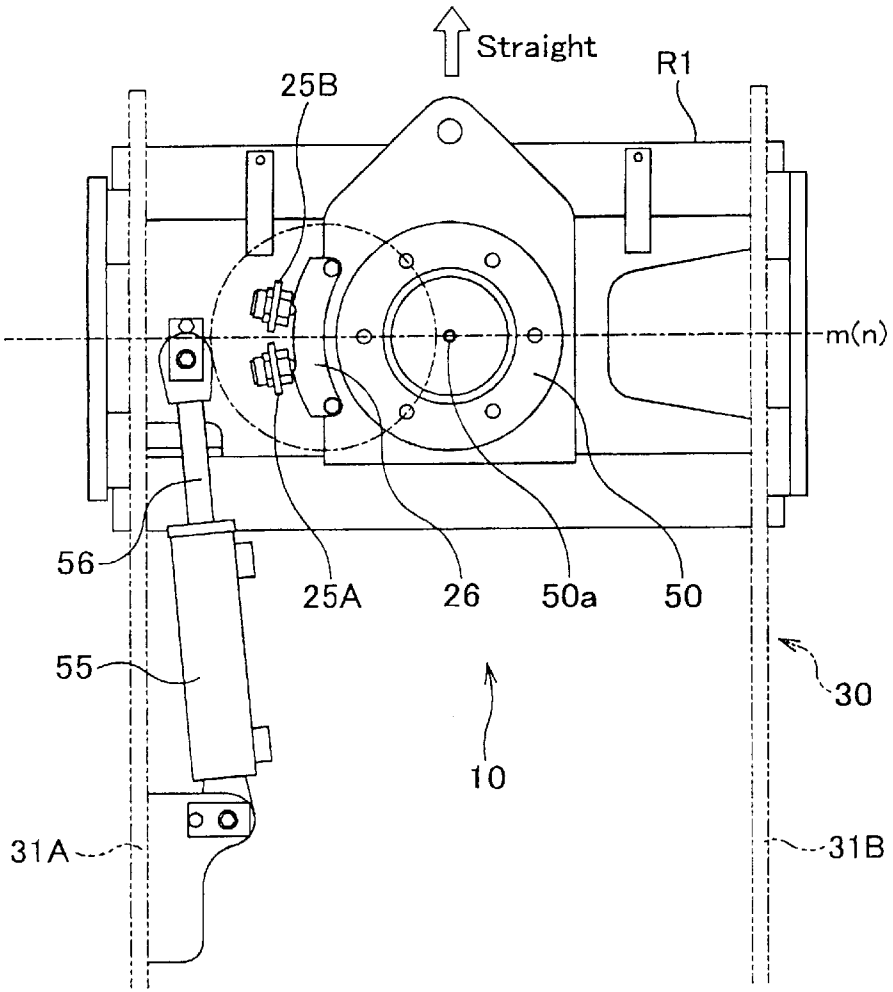
Figure 8F:
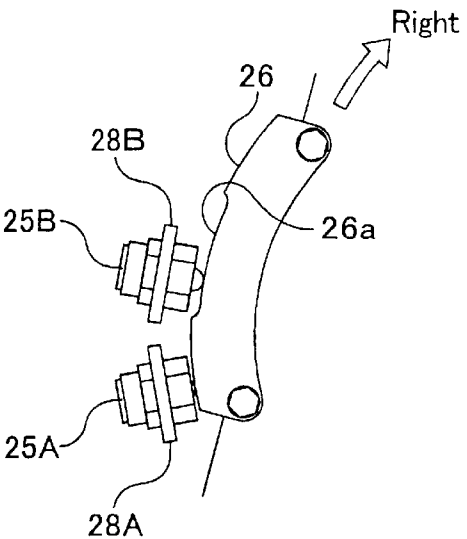
Figure 8E:
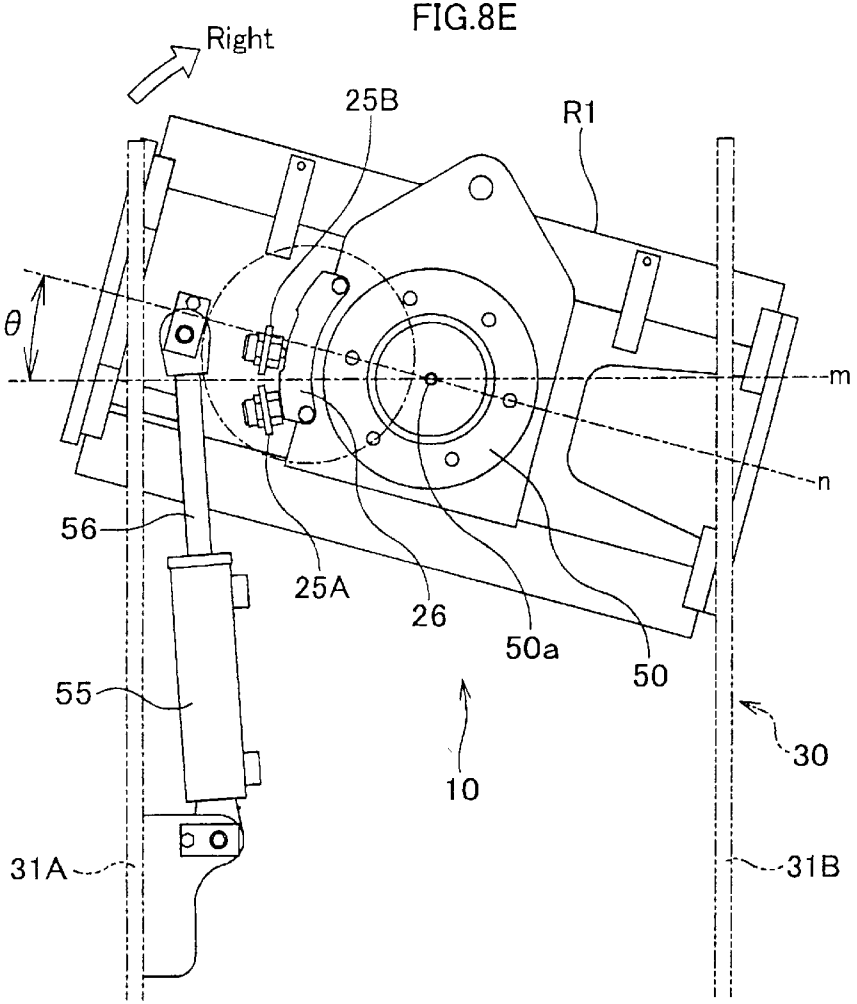

In order to restore the front wheel roller R1 to the neutral position from the present position, the neutral switch 75C is pushed to operate the automatic roller wheel neutralizing apparatus T (see FIGS. 8C, 8D).

Further, in the case of the counterclockwise rotation, the left steering switch 75A is pushed. Then, the left solenoid 65A is energized and the passage of the solenoid switching valve 65 is switched. The cylinder rod 56 contracts and the front roller wheel R1 is rotated counterclockwise over the supporting frame 10 (see FIGS. 8A, 8B).

As described above, according to the hand guided vibrating roller H of the present embodiment, the conventional operation that the worker holds the steering rod with both hands to operate it with all his strength is not needed. The worker can operate the steering with one hand and one finger, so that the hand guided vibrating roller has the improved operating performance.

Figure 9:
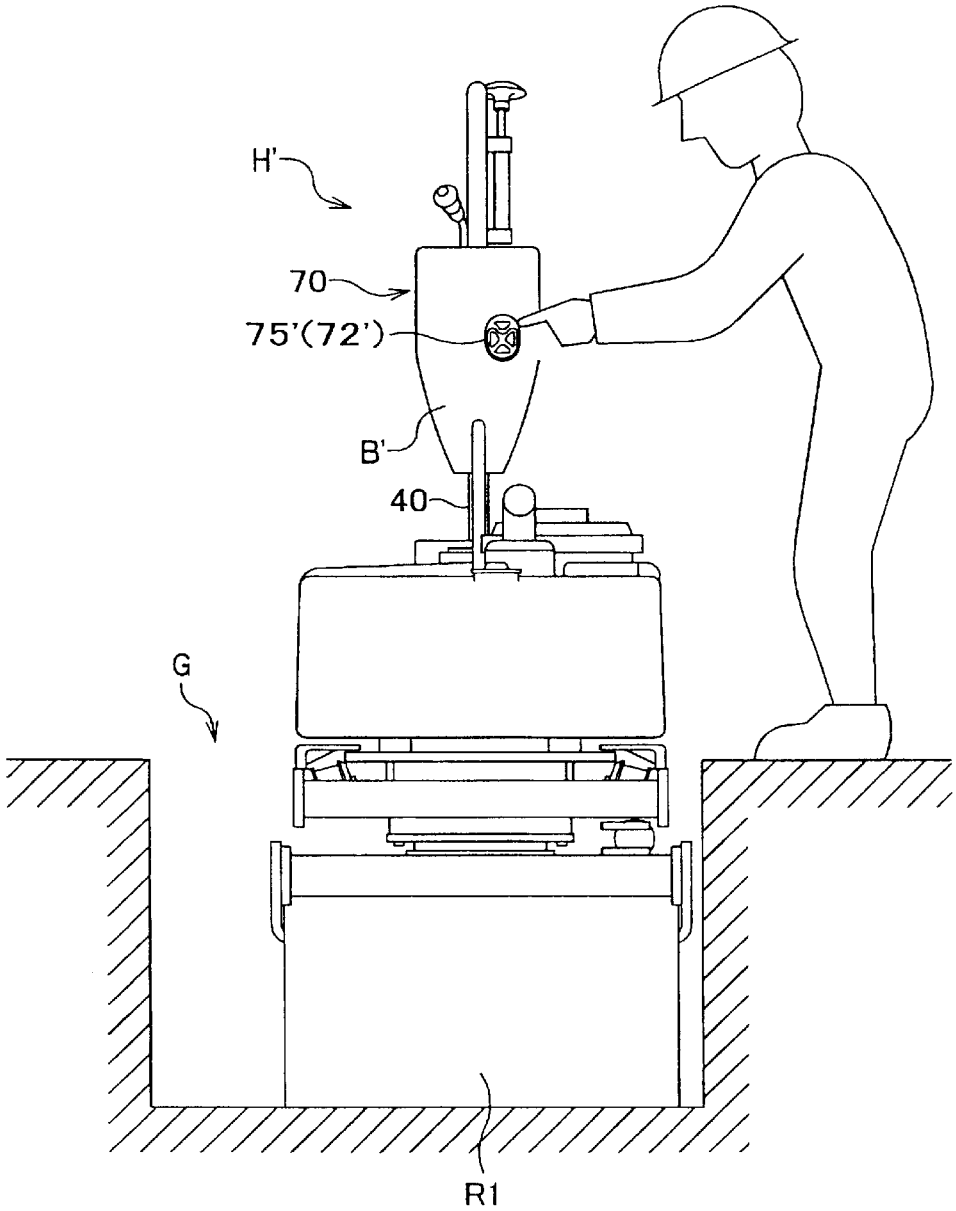
FIG. 9 is a front view showing the use of the hand guided vibrating roller of the first embodiment.

Accordingly, as shown in FIG. 9, when the hand guided vibrating roller H is placed and operated in the narrow ditch G, the worker operates the drive operating unit 70 at the ground with the steering rod 40 folded. Therefore, the work efficiency is sharply improved.

In the present embodiment, the forward-backward movement lever 72 is hand-operated; however, an electric circuit for controlling the rotating direction of the front and rear roller wheels R1, R2 and means of operating the electric circuit can be provided and the steering switch and the means of operating the electric circuit may be remote-controlled, which further improves the usefulness of the operation.

<Second Embodiment>

A hand guided vibrating roller H' according to the second embodiment of the present invention is different from the one of the first embodiment in the presence of the supporting structure of the hydraulic hoses in the hollow portion of the slewing rim bearing 50' and the drain hose line 68, while will be described in detail.

Figure 10A:
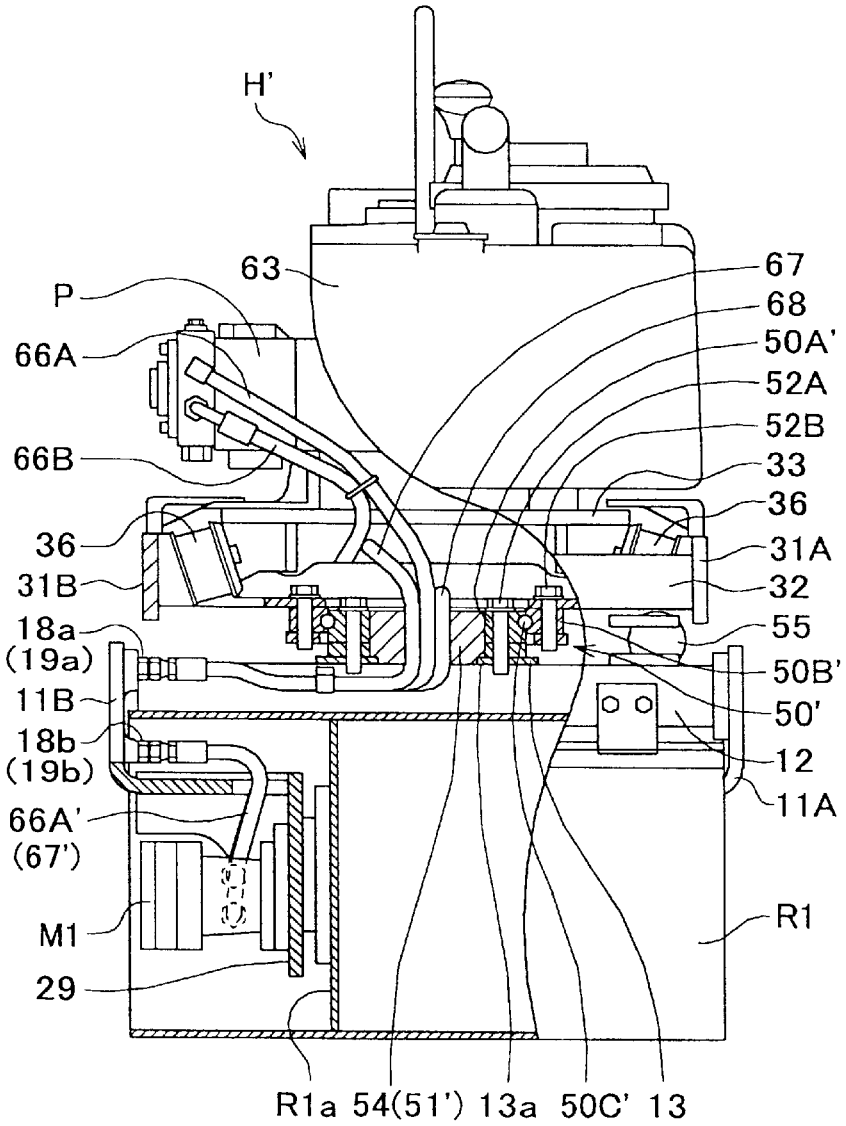
FIG. 10A is a front view showing a hand guided vibrating roller according to the second embodiment of the present invention partially showing the inside.
Figure 10B:
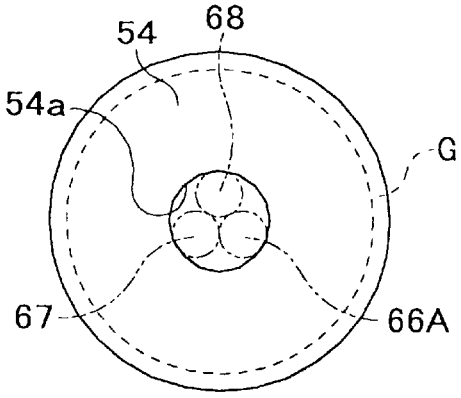
FIG. 10B is a plan view showing a fixing member of the hand guided vibrating roller of FIG. 10A.
Figure 10C:
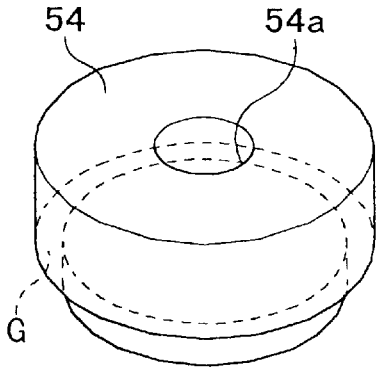
FIG. 10C is a perspective view showing the fixing member.

As shown in FIGS. 10A, 10B, 10C, the slewing rim bearing 50 comprises an inner ring 50A' placed above the circular bearing support 13 welded at the center of the lower beam material 12, an outer ring 50B' outside the inner ring 50A', a rotating unit 50C' provided there between. The inner ring 50A' is fixed at the lower beam material 12 with a bolt 52A and the outer ring 50B' is fixed at the upper beam material 32 with the bolt 52B, and both can be rotated around the center of rotation 50*a*.

There is a hollow portion 51' inside the inner ring 50A, and a fixing member for the oil hose line (fixing member 54) is fitted in the hollow portion 51'. The fixing member 54 is a cylindrical member having the outer diameter as same as the inner diameter of the inner ring 50A' and has a locking step G at the bottom with the smaller diameter. The locking step G is locked with the end 13*a* of the bearing support 13 to be inserted in the hollow portion 51'.

There is a through hole (circular hole) for the hydraulic hose (through hole 54*a*) in the center of the fixing member 54. The through hole 54*a* has a suitable size for holding the movement of the hydraulic hoses.

The hose lines 66A, 67 which are the hydraulic hoses and the drain hose line 68 connecting the hydraulic motor M1 with the oil tank 63 are inserted and held in the through hole 54*a*. Accordingly, the hose lines 66A, 67 and the drain hose line 68 are prevented from touching the inner ring 50A' of the slewing rim bearing 50, which protects the hose lines.

As only the fixing member 54 is fitted in the hollow portion 51', it can hold the movement of the hose lines 66A, 67 and the drain hose line 68, which is very useful.

Figure 11A:
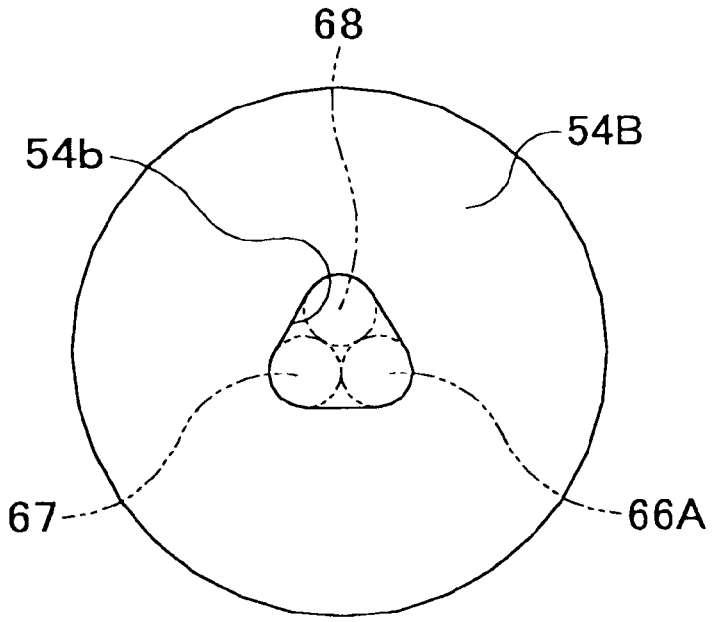
FIGS. 11A, 11B are plan views showing another aspect of the fixing member.
Figure 11B:
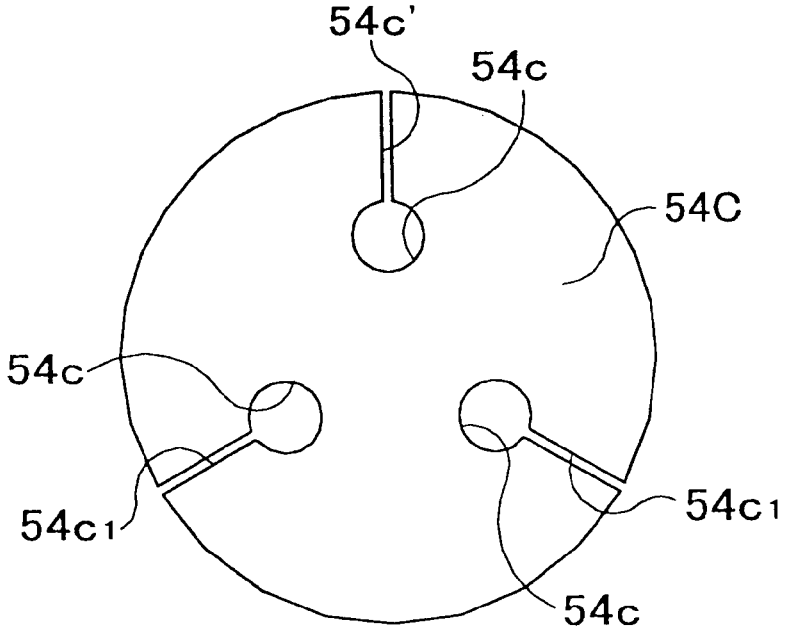

The through hole for the fixing member 54 is not limited to the circular hole. It may be a triangular-shaped through hole 54B (see a fixing member 54B of FIG. 11A). Further, plural through holes may be formed and each hydraulic hose is inserted in one through hole. For example, as shown in FIG. 11B, one through hole is formed by a narrow groove 54*c*' cut from the fixing member 54C towards the circumference and a small circular hole 54*c* adjacent to the narrow groove 54*c*'. In this case, when the drain hose line is not provided as in the first embodiment, the number of the through holes is the number of the hydraulic hoses.

Figure 12A:
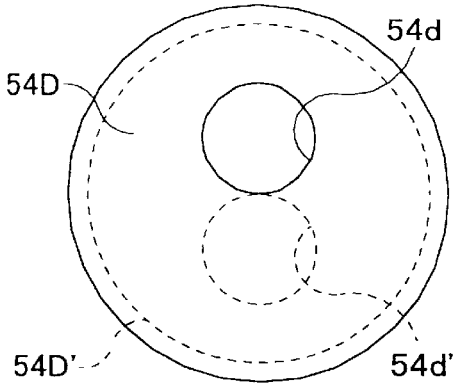
FIGS. 12A, 12C, 12E, are plan views showing another aspect of the fixing member
Figure 12B:
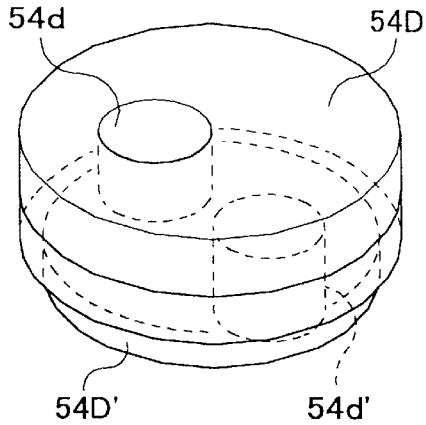
FIGS. 12B, 12D, 12F are perspective view showing the use of the fixing member.
Figure 12C:
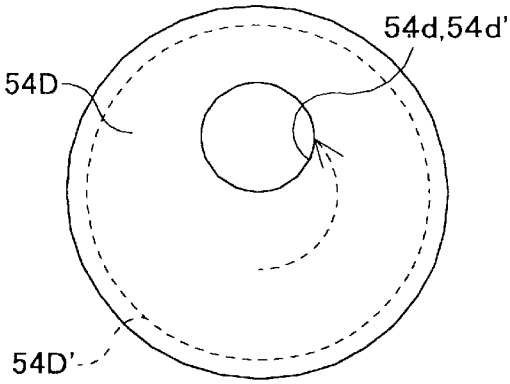
Figure 12D:
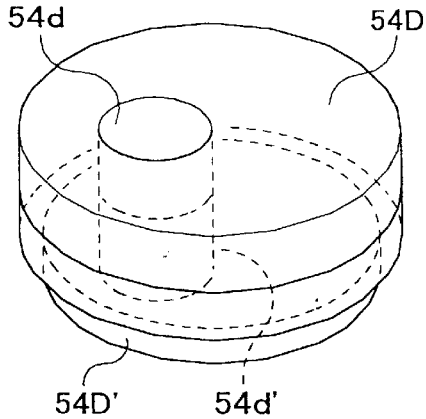
Figure 12E:
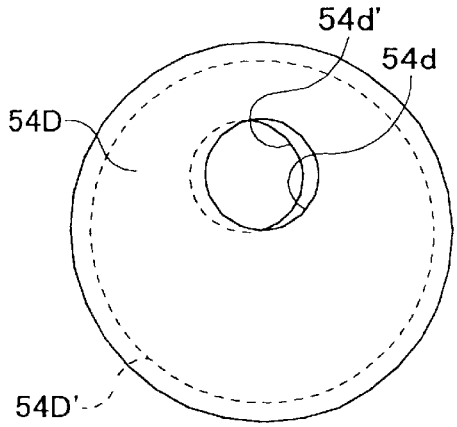
Figure 12F:
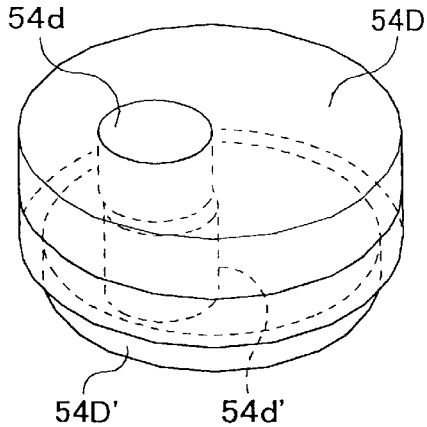

Further, as shown in FIGS. 12A, 12B, the fixing member may be divided into an upper portion 54D and a lower portion 54D' and the same through holes 54*d*, 54*d*' are formed in each portion. The hydraulic hoses or drain hose line are inserted in the through holes 54*d*, 54*d*'. Furthermore, one of the upper and lower portions 54D, 54D' is rotated (e.g., the upper portion 54D) (see FIGS. 12C, 12D) to adjust the space between the through holes 54*d*, 54*d*' to hold the hydraulic hoses or drain hose line (see FIGS. 12E, 12F).

The preferred embodiments of the present invention have been described; however, the present invention is not limited to the above-described embodiments. Every constituting elements can be changed without departing from the scope of the invention. In particular, it is preferred that the supporting frame 10 and the machine 30 are rotatively supported using the mechanism with the slewing rim bearing. However, another configuration may be used such as the mechanism with the bearing and the pivot unless the supporting frame 10 and the machine 30 is rotated freely.

Further, the directional roller wheel is the front roller wheel R1 but it may be the rear roller wheel R2 or it may be both of the front and rear roller wheels R1 and R2.

Furthermore, it is preferred that the steering switch 75 as the solenoid switching valve operating means is provided to the forward-backward movement lever 72 but it can be provided to other portion.

Further, the fixing member for the hydraulic hoses can be used to fix the cable of the electric product and wiring.

According to the present invention, since the directional roller wheel can be rotated through the supporting frame by an actuator such as the hydraulic cylinder, the steering is not hand-operated and the fatigues of the steering can be relieved and the safety can be improved. Further, the worker does not need to operate the steering rod by hand to rotate the supporting frame, so that the long steering rod is not needed and the length of the rear portion of the hand guided vibrating roller can be made short comparing to the conventional hand guided vibrating roller (conventionally the length is about 1.4 m).

Thus, the length of the rear portion of the roller can be made small, so that the steering can be performed efficiently in the compacting operation of the narrow road or the narrow ditch.

Further, in the case of the use of the hydraulic cylinder as an actuator, the following effects can be achieved. The hydraulic cylinder is connected to the pressure oil supplying means with the hydraulic hoses having the directional control valve, and the directional control valve operating means for operating the switch of the directional control valve is provided to the drive operating unit of the steering rod, so that the steering can be performed by operating only the drive operating unit. Accordingly, the conventional operation that the worker holds the steering rod with both hands to operate it with all his strength is not needed. The worker can operate the steering with one hand and one finger, so that the hand guided vibrating roller as the improved operating performance.

Therefore, the hand guided vibrating roller can be operated from the side of the steering rod, so that it can be operated outside the work area under the compacting operation, which can improve the quality of the compacted area.

Further, since the automatic roller wheel neutral apparatus is provided, the directional roller wheel of the hand guided vibrating roller is automatically made in the straight forward traveling state, so that the operating performance can sharply be enhanced.

Further, according to the present invention, the fixing member for the hydraulic hoses is fitted in the hollow portion to hold the movement of the hydraulic hoses inserted therein, so that the hydraulic hoses are prevented from touching the inner face of the slewing rim bearing, which protects the hydraulic hoses.

While the invention has been shown and described with reference to the illustrated embodiment, it should be understood that various changes in form and details may be made without departing from the scope of the invention which is defined in the appended claims.

What is claimed is:

1. A hand guided vibrating roller comprising a pair of front and rear roller wheels provided in parallel, a machine supported by said pair of the front and rear roller wheels, a hydraulic pump mounted on said machine, a hydraulic motor for driving said roller wheels, provided inside said roller wheels, and a steering rod elongating from the rear portion of said machine, said hand guided vibrating roller comprising:

a supporting frame freely rotated around a vertical axis, supporting at least one of said roller wheels; and an actuator for rotating said supporting frame, wherein said supporting frame is rotatively supported by a slewing rim bearing provided right above said roller wheel, and said hydraulic pump and said hydraulic motor for driving said roller wheel are jointed by hydraulic hoses inserted into a hollow portion of said slewing rim bearing.

2. A hand guided vibrating roller according to claim 1, wherein a fixing member having a through hole for the hydraulic hose is fitted in the hollow portion of said slewing rim bearing.

3. A hand guided vibrating roller comprising a pair of front and rear roller wheels provided in parallel, a machine supported by said pair of the front and rear roller wheels, a hydraulic pump mounted on said machine, a hydraulic motor for driving said roller wheels, provided inside said roller wheels, and a steering rod elongating from the rear portion of said machine, said hand guided vibrating roller comprising:

a supporting frame freely rotated around a vertical axis, supporting at least one of said roller wheels;

an actuator for rotating said supporting frame; and an automatic roller wheel neutralizing apparatus comprising:

a rotating position detecting means for detecting the rotating position of said roller wheel rotated in one direction around a vertical axis, and a neutral position restoring means for restoring said roller wheel to the straight forward traveling state by rotating said roller wheel in the direction opposite to the current rotating direction based on said rotating position detected by said rotating position detecting means.

* * * * *